US010233932B2

(12) United States Patent
Orue Orue et al.

(10) Patent No.: US 10,233,932 B2
(45) Date of Patent: Mar. 19, 2019

(54) ELECTRIC PUMP

(71) Applicants: Rodrigo Orue Orue, Elorrio (ES); Joseba Barbara Ganzabal, Laudio (ES)

(72) Inventors: Rodrigo Orue Orue, Elorrio (ES); Joseba Barbara Ganzabal, Laudio (ES)

(73) Assignee: COPRECI, S. COOP., Aretxbaleta (ES)

( * ) Notice: Subject to any disclaimer, the term of this patent is extended or adjusted under 35 U.S.C. 154(b) by 466 days.

(21) Appl. No.: 14/994,745

(22) Filed: Jan. 13, 2016

(65) Prior Publication Data

US 2016/0201681 A1 Jul. 14, 2016

(30) Foreign Application Priority Data

Jan. 14, 2015 (ES) ..... 201530032

(51) Int. Cl.
*F04D 13/06* (2006.01)
*F04D 3/00* (2006.01)
(Continued)

(52) U.S. Cl.
CPC ..... *F04D 13/06* (2013.01); *F04D 3/00* (2013.01); *F04D 13/0693* (2013.01);
(Continued)

(58) Field of Classification Search
CPC ... F04D 13/0693; F04D 29/086; H02K 5/128; H02K 5/132; H02K 9/19
See application file for complete search history.

(56) References Cited

U.S. PATENT DOCUMENTS 3,587,939 A * 6/1971 Nystuen et al. .... A47L 15/4225 137/565.37
3,750,951 A * 8/1973 Perl ..... A47L 15/4225 134/186
(Continued)

FOREIGN PATENT DOCUMENTS

CN 102108966 A 6/2011
CN 103516090 A 6/2012
(Continued)

*Primary Examiner* — Patrick Hamo
(74) *Attorney, Agent, or Firm* — Edell, Shapiro & Finnan, LLC

(57) ABSTRACT

An electric motor driven that includes a pump body and a motor body having a rotor enclosure coupled to the pump body. The motor body further includes a rotatable impeller arranged on a first side of the rotor enclosure. An electric motor arranged on a second side of the rotor enclosure, opposite the first side, the electric motor having a stator, at least one stator coil, terminals connected to the stator coil and a rotor, the rotor including a shaft that is coupled with the impeller. A cover is disposed over the electric motor, the cover having an open end that is attached to the rotor enclosure in a manner that produces a leak-tight chamber inside the cover, the stator and stator coil being arranged inside the leak-tight chamber, the leak-tight chamber being filled with a non-gaseous filler material, the non-gaseous filler material having a thermal conductivity greater than air.

19 Claims, 5 Drawing Sheets

(51) Int. Cl.

| | |
|---|---|
| ***F04D 29/18*** | (2006.01) |
| ***F04D 29/58*** | (2006.01) |
| ***F04D 29/08*** | (2006.01) |
| ***F04D 29/42*** | (2006.01) |

(52) U.S. Cl.
CPC ..... *F04D 29/086* (2013.01); *F04D 29/18* (2013.01); *F04D 29/426* (2013.01); *F04D 29/5806* (2013.01); *F04D 29/586* (2013.01); *F05D 2260/22141* (2013.01)

(56) References Cited

U.S. PATENT DOCUMENTS

| | | | | |
|---|---|---|---|---|
| 4,247,265 | A * | 1/1981 | Cavalcante | A01K 63/047 417/423.7 |
| 5,291,087 | A * | 3/1994 | Pollick | F04D 23/008 310/86 |
| 6,188,154 | B1 * | 2/2001 | Luedtke | H01H 37/767 310/239 |
| 6,837,688 | B2 * | 1/2005 | Kimberlin | F04D 13/064 417/32 |
| 8,613,605 | B2 * | 12/2013 | Hammar | F04D 29/4273 415/119 |
| 8,786,147 | B2 | 7/2014 | Kawashima et al. | |

FOREIGN PATENT DOCUMENTS

| | | | |
|---|---|---|---|
| EP | 1081825 | A1 | 3/2001 |
| ES | 1101080 | | 2/2014 |
| WO | 2012024778 | A1 | 3/2012 |

* cited by examiner

ELECTRIC PUMP

CROSS-REFERENCE TO RELATED APPLICATIONS

This application relates to and claims the benefit and priority to Spanish Application No. 201530032, filed Jan. 14, 2015.

TECHNICAL FIELD

The present invention relates to electric motor driven pumps.

BACKGROUND

Using electric pumps to drive a fluid, usually water, is known. Such pumps are used in washing machines or dishwashers, for example, to drain, at the end of a washing cycle, the water contained in the washing drum or tub out or towards a recirculation conduit that introduces said water back into the tub. In such pumps there are clearly two functional parts, the first refers to the part where the fluid is prepared so that it can be expelled through an expulsion element or impeller, and the second refers to the part where said element is made to rotate in order to allow driving said fluid.

Synchronous, preferably brushless, motors are normally used in such pumps, although asynchronous motors can also be used. A synchronous motor is a type of AC (alternating current) motor in which the rotation of the shaft of the rotor that moves the impeller is synchronized with the frequency of the supply current. The magnetic field required to make the shaft of the rotor rotate is generated by circulating an electric current through a coil arranged around the stator.

ES1101080 U discloses a drain pump comprising a pump body, in connection with the hydraulic part, and a motor body, in connection with the motorized part of the pump. The motor body comprises a rotor enclosure coupled to the pump body to close the pump at one end, an impeller arranged on one side of the rotor enclosure and a synchronous motor arranged on the other side of the rotor enclosure. The synchronous motor comprises a stator with a winding and a rotor with a shaft which is coupled to the impeller.

SUMMARY OF THE DISCLOSURE

According to one implementation an electric pump is provided that comprises a pump body and a motor body. The motor body includes a rotor enclosure by means of which it is coupled to the pump body, a rotatable impeller, and an electric motor which may be a synchronous motor. The impeller is arranged on one side of the rotor enclosure whereas the motor is arranged on the other side. The electric motor comprises a stator, at least one stator coil and a rotor comprising a shaft that is coupled with the impeller.

The pump may also comprise a cover attached to the rotor enclosure in which the stator and coil/coils are arranged. The cover defines a chamber that is filled with a non-gaseous filler material having a thermal conductivity greater than air. The filler material may be a liquid, gel or a solid. Heat is transferred by conduction and convection (e.g., in the event the filler material is a liquid) from the various parts of the electric motor to the cover via the filler material. According to some implementations, such as when the filler material is a liquid or gel, the filler material is maintained in the chamber in a leak-tight manner. In such an implementation, during assembly the stator and coil/coils are arranged inside the cover with the chamber being subsequently filled with the filler material and then sealed. According to some implementations the filler material is oil, such as, for example, a vegetable oil.

By improving the thermal dissipation of heat generated by the electric motor, the electrical performance of the motor itself is improved as a result of a reduction in temperature of the winding(s) and other parts of the motor. This reduction in temperature advantageously makes it possible to reduce the size of the electric motor. A reduction in size of the pump permits its use in a wider range of applications and also results in reduced material costs.

The noise generated by the electric motor is also advantageously reduced, particularly when the filler material includes a liquid or gel, as a result of the vibrations being dampened by the filler material.

These and other advantages and features will become evident in view of the drawings and detailed description.

DETAILED DESCRIPTION

Figure 1:
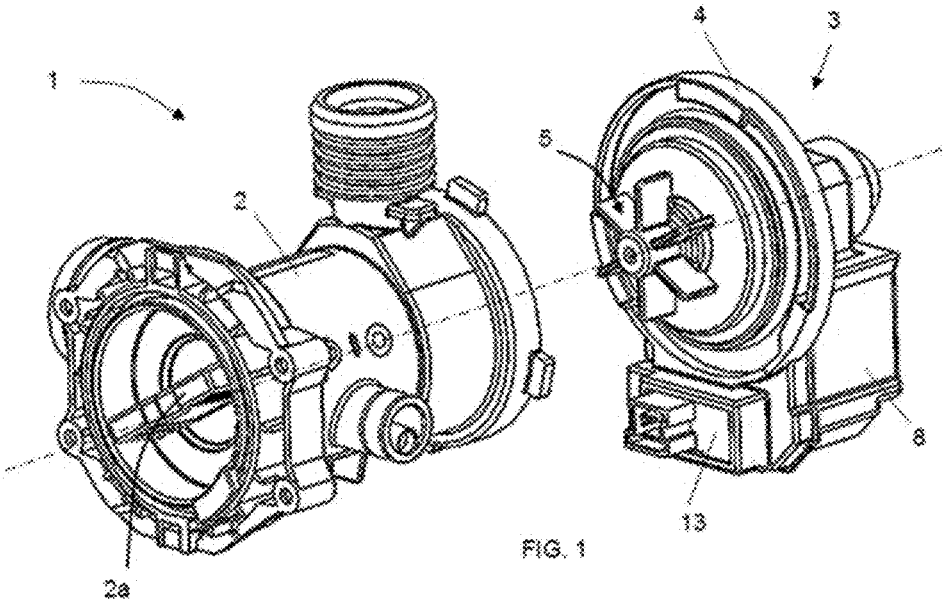
FIG. 1 shows a perspective view of an electric pump according to one implementation, with the pump body and the motor body uncoupled from one another.
Figure 2:
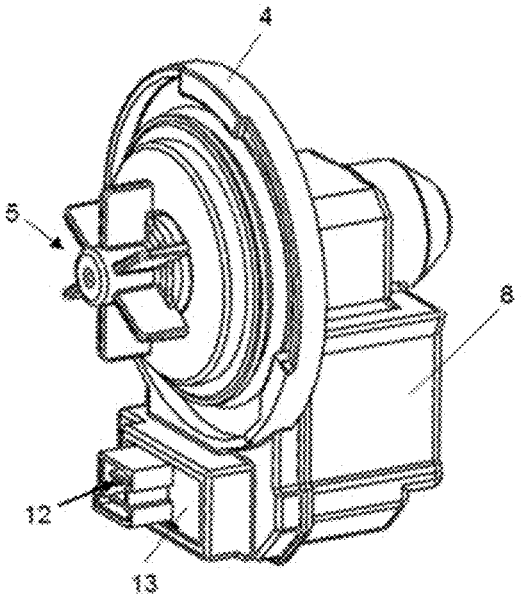
FIG. 2 shows a perspective view of the motor body of the pump of FIG. 1.

According to one implementation an electric pump 1 is provided that includes a pump body 2 (in connection with the hydraulic part of the pump), and a motor body 3 (in connection with the motorized part of the pump). The motor body 3 comprises a rotor enclosure 4 by means of which said motor body 3 is coupled at one end of the pump body 2, enabling the closure thereof at said end. The other end of the pump body 2 is closed with a filter 2*a* which is arranged inside the pump body 2. The pump 1 also comprises an impeller 5 and an electric motor 20, such as a synchronous motor. The impeller 5 is arranged on one side of the rotor enclosure 4 whereas the electric motor 20 is arranged on the other side, as shown in FIGS. 1 and 2. The electric motor 20, which is either single-phase or polyphase, comprises a stator 6 and at least one stator coil 6*a*, and a rotor 7 comprising a shaft 7*a* that is coupled to the impeller 5.

According to one implementation the pump 1 also comprises a cover 8 attached to the rotor enclosure 4 in a leak-tight manner such that a leak-tight chamber 9 is formed therein. The stator 6 and the stator coil 6*a* are arranged inside the leak-tight chamber 9 and said chamber 9 is filled with a non-gaseous filler material having a thermal conductivity greater than air. The filler material may be a liquid, gel or a solid. The filler material preferably has a thermal conductivity that is at least five times greater than the thermal conductivity of air under ambient room temperature and pressure conditions.

The use of the filler material permits the heat generated in the electric motor (which is usually generated by the passage of an electric current through coil/coils 6*a* of stator 6) to be more quickly evacuated to the cover 8 and then on to the atmosphere, thereby minimizing the occurrence of motor overheating. Compliance with safety regulations are more easily attainable as a result of the stator coil 6*a* of the motor operating at a lower temperature range.

Alternatively, if working in the same temperature range is desirable, the use of the filler material permits a reduction in the volume of stator coil 6*a*. A reduction in the volume of the stator coil 6*a* has at least two advantages. First, it results in lower material costs. Secondly, it reduces the size of the stator 6, permitting a more compact and lighter weight design.

The current circulating through the stator coil 6*a* is inversely proportional to the impedance opposing the stator coil 6*a* itself. The longer the length of the coil 6*a* the more it opposes the passage of electric current, so current intensity is lower. Similarly, the shorter the length of the coil 6*a* the less it opposes the passage of electric current, so current intensity is greater. Again, the use of the filler material provides greater flexibility in the design of the electric motor 20 by dissipating heat generated by the motor more quickly and efficiently as opposed to when the cover 8 is filled with air. For example, a wider change of current intensities is acceptable without the risk of overheating the motor.

The stator 6 of the motor 20 may comprise a single coil or multiple coils.

As noted above, the pump 1 also operates quieter as a result of the filler material dampening vibrations generated within the motor 20.

According to one implementation, the filler material is an oil that facilitates heat transfer by both convection and conduction.

According to one implementation the stator coil 6*a* is arranged inside the leak-tight chamber 9 which is filled with oil, or another liquid or gel, providing the chamber 9 with lack of oxygen. Since there is a lack of oxygen, the galvanic corrosion of the wire of the stator coil 6*a* is therefore avoided along with other components disposed inside the leak-tight chamber 9. In the hypothetical case that the motor overheats, propagation of a possible flame would be avoided because of this lack of oxygen.

According to some implementations the filler material is a dielectric material which avoids having to isolate motor components such as the stator coil 6*a*, the stator 6, etc.

According to some implementations the pump 1 includes a thermal protector 17, such as a bimetal switch, connected in series with the coil 6*a* and an external power source in a known manner. The thermal protector 17 is configured to interrupt the current circulating through the coil 6*a* in case of overheating.

Figure 4:
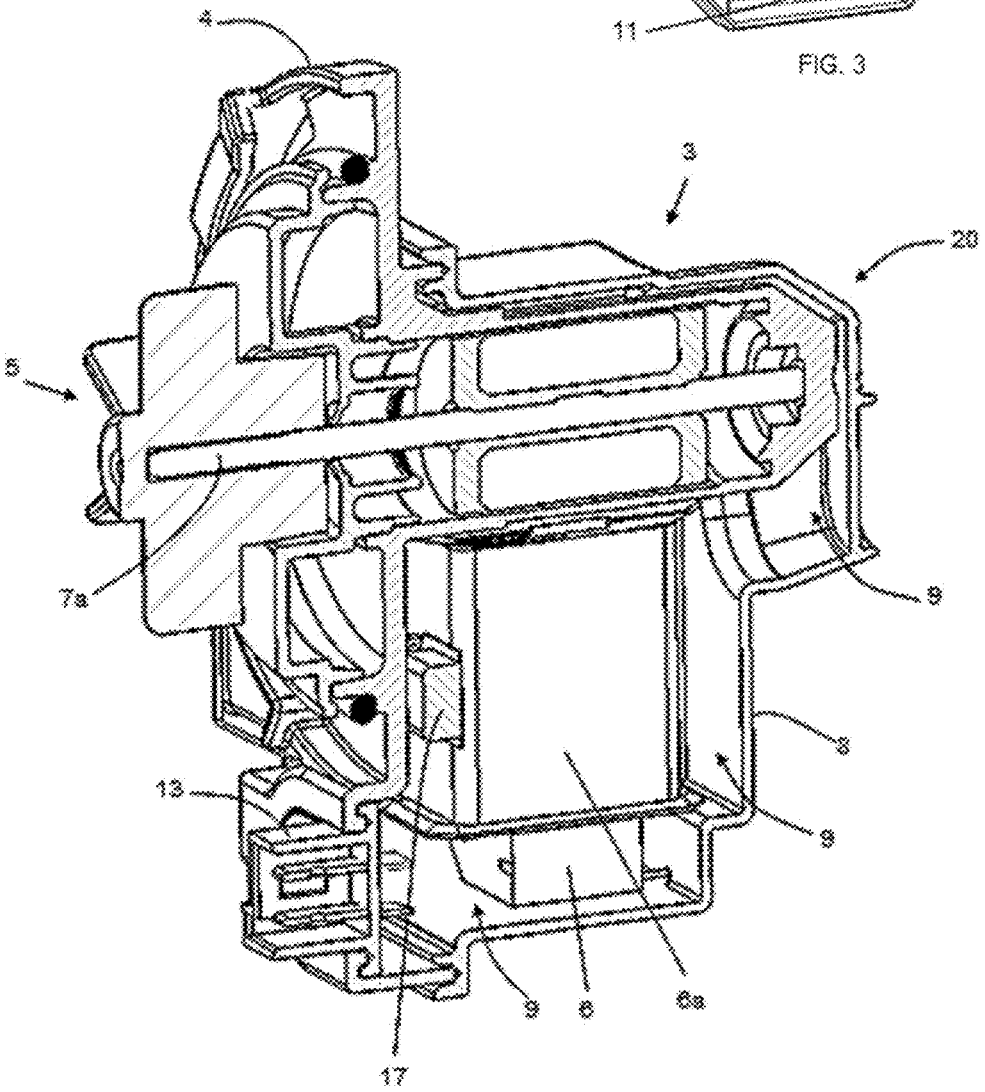
FIG. 4 is a sectional view of the motor body of FIG. 2.

According to some implementations the thermal protector 17 is disposed inside the leak-tight chamber 9 as can be seen in FIG. 4, and therefore it is in contact with the filler material. Advantageously, the thermal protector 17, since it is in contact with the filler material, is more sensitive to the temperature variations of the coil 6*a* and is able to react faster to cut power to the motor 20 in an overheating event.

Figure 3:
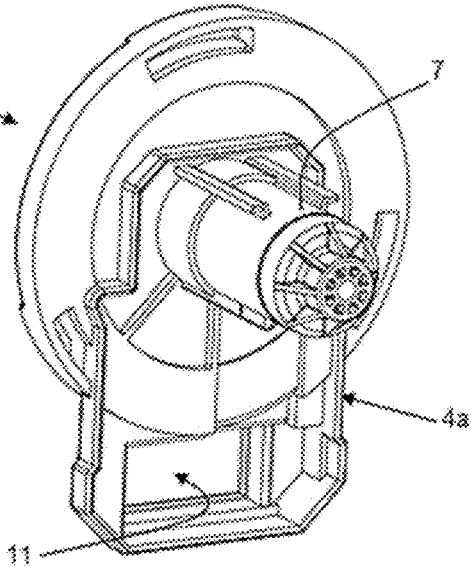
FIG. 3 shows a perspective view of the rotor enclosure of the motor body of FIG. 2.
Figure 5:
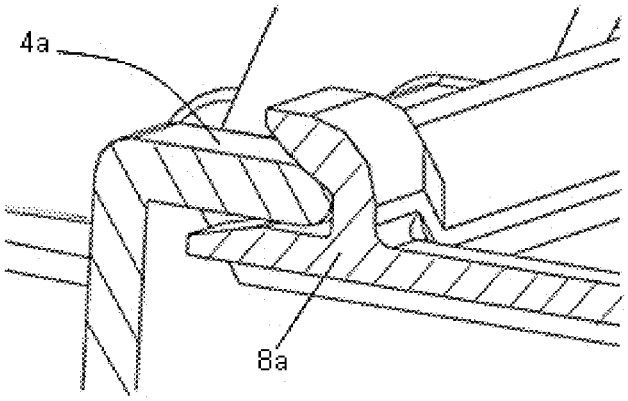
FIG. 5 is a detail of the motor body of FIG. 2.

According to some implementations to provide a leak-tight closure between the rotor enclosure 4 and the cover 8, the rotor enclosure 4 comprises a male profile 4*a*, such as that shown in FIG. 3, axially projecting from the side where the electric motor is arranged, and the cover 8 comprises in the contour of the free end an female profile 8*a* cooperating with the male profile 4*a* of the rotor enclosure 4, as shown in the detail of FIG. 5.

According to some implementations the female profile 8*a* comprises a V-like or U-like shape or similar, such that the male profile 4*a* of the rotor enclosure 4 is introduced by means of form fitting, thereby being housed therein. However, to ensure leak-tightness in the entire attachment joint once the male profile 4*a* has been fixed in the female profile 8*a*, according to some implementations a sealing operation is carried out, for example by means of laser, welding, ultrasound, hot-ironing, gluing, siliconizing, etc. A leak-tight attachment is thereby ensured without having to use elastic gaskets, O-rings, or the like.

Alternatively an elastic gasket, O-ring or the like may be situated between the male profile 4*a* of the rotor enclosure 4 and the female profile 8*a* of the cover 8 in order to effectuate a leak-tight attachment between the cover 8 and the rotor enclosure 4. The sealing process described in the preceding paragraph is thereby avoided.

The electric motor 20 comprises terminals 12 enabling the connection of the motor 20 to an external power source. The terminals 12 are at least partly disposed inside the leak-tight chamber 9 (the part that is connected with the coil 6*a*) and are therefore in contact with the filler material. In this way, in the event of a short circuit where a local overheat can be generated near the connection area of the terminals 12 and the coil 6*a*, the filler material more readily dissipates the heat to reduce the likelihood of plastic deformation of surrounding plastic components and the occurrence of flame.

According to one implementation the rotor enclosure 4 comprises in the front or rear lower part, a window 11 that allows the passage of the terminals 12. When the filler material is a liquid or gel it is necessary to also seal the window 11 so that the chamber 9 is leak-tight. To this end a leak-tight seal is provided in a terminal connection part 13 arranged in the window 11 as shown in FIG. 4. According to some implementations the terminal connection part 13 is made of plastic, preferably rigid, which is attached to the rotor enclosure 4 by carrying out a subsequent sealing operation around the periphery of the window 11, for example by welding or by means of an adhesive, such as gluing.

Figure 6A:
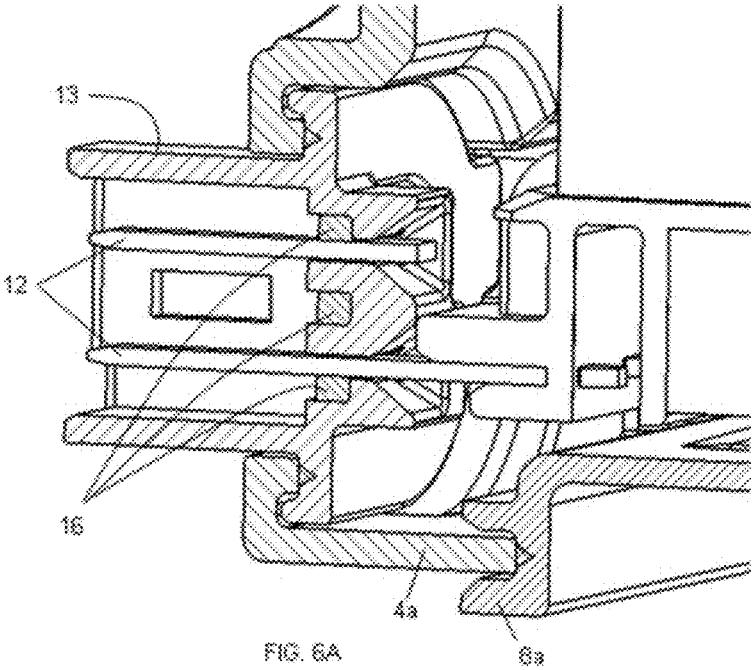
FIG. 6A is another sectional view of the motor body of FIG. 2 comprising a terminal connection part of a first type.

In order to seal the terminals 12, after sealing the terminal connection part 13 with the window 11 of the rotor enclosure 4 in a leak-tight manner, the terminals 12 are assembled in the part 13 and then a sealant (for example, an epoxy resin) is applied over parts of terminal connecting part 13 and the terminals 12 as shown in FIG. 6A, so that an elastic sealing 16 is formed and therefore the terminals 12 are sealed in a leak-tight manner.

Figure 6B:
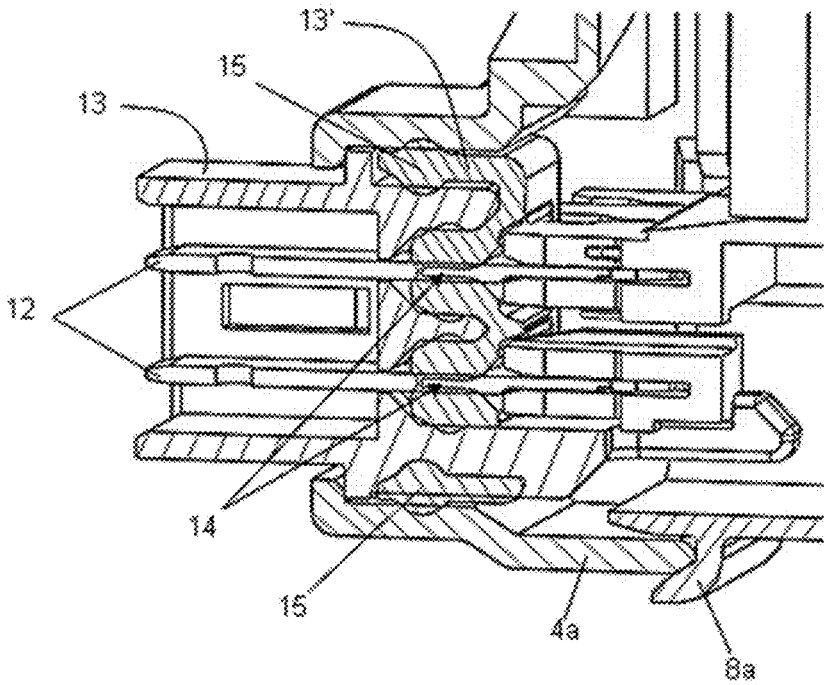
FIG. 6B is another sectional view of the motor body of FIG. 2 comprising a terminal connection part of a second type.

According to other implementations, as shown in FIG. 6B, an elastic sealing part 13' is provided that provides a sealing between the terminal connection part 13 and window 11 and also a sealing of the terminals 12 within the terminal connection part 13. The elastic sealing part 13' is arranged at the end of the terminal connection part 13 close to the electric motor 20. The elastic sealing part 13' comprises a first portion 15 that seals the interface between the terminal connection part 13 and the window 11, the first portion 15 being in contact with the inner face of the window 11, as seen in FIG. 6B. When the terminal connection part 13 is introduced in the window 11, the first portion 15 of the elastic sealing part 13' is deformed and applies pressure against the inner face of the window 11. A sealing between the terminal connection part 13 and inner face of the window 11 may optionally be accomplished with the use of other types of elastic joints.

Figure 6C:
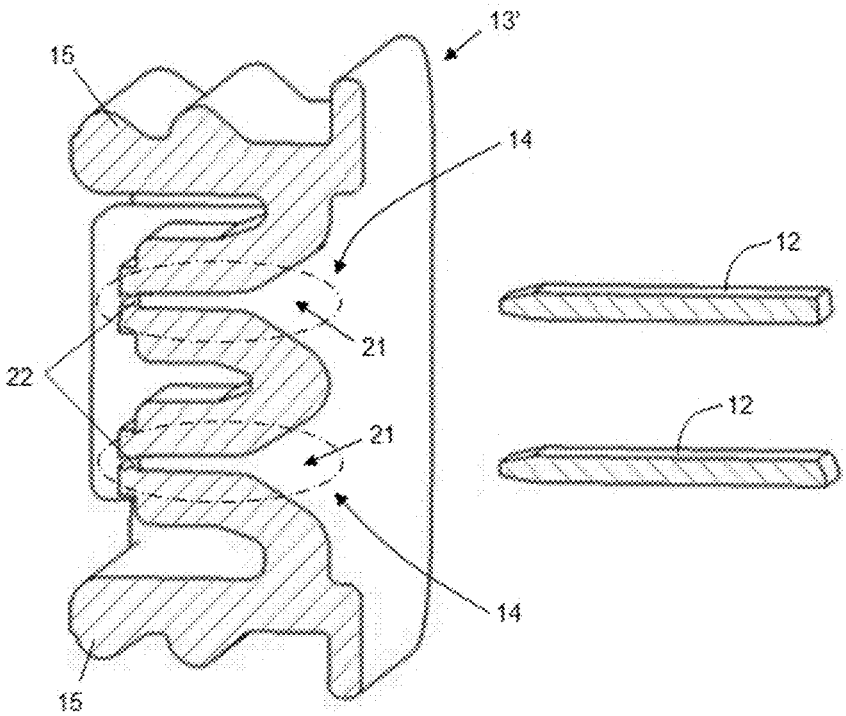
FIG. 6C shows the elastic sealing part of the terminal connection part illustrated in FIG. 6B.

With reference to FIGS. 6B and 6C, the elastic sealing part 13' also comprises a constricted and elastic portion 14 that provides a sealing about each of the terminals 12. The opening 21 through which the corresponding terminal 12 must be introduced is wider than the remaining passage as to make guiding the terminal 12 into the elastic seal part 13' easier. The opposite side of the elastic sealing part 13' through which the terminals 12 exit is sized so that it is able to close up around the respective terminals 12 to effectuate a fluid tight seal around the terminals. According to one embodiment, the elastic sealing part 13' includes thin membranes 22 that break when the corresponding terminals 12 are introduced, such that when the terminal 12 is introduced, the narrowest area of said constricted area 14 comes into contact with said terminal 12, also applying pressure against the terminal 12.

The terminal connection part 13 may take any of a variety of forms to be adapted to different types and positions of the terminals 12. This provides greater versatility in the types of electrical connections that may be selected for use in the pump 1.

The cover 8 may be formed as a single part or of several parts attached to one another in a leak-tight manner. The cover 8 may further comprise different materials. This latter variant can be useful, for example, in obtaining a cover 8 with different materials and geometries that help to direct and optimize heat transfer into and out of the cover.

According to some implementations the cover 8 is made of the same material as the rotor enclosure 4. The material may be a plastic, such as polypropylene. As already mentioned in the preceding paragraph, is it not ruled out that the cover 8 may comprise more than one material.

Figure 7:
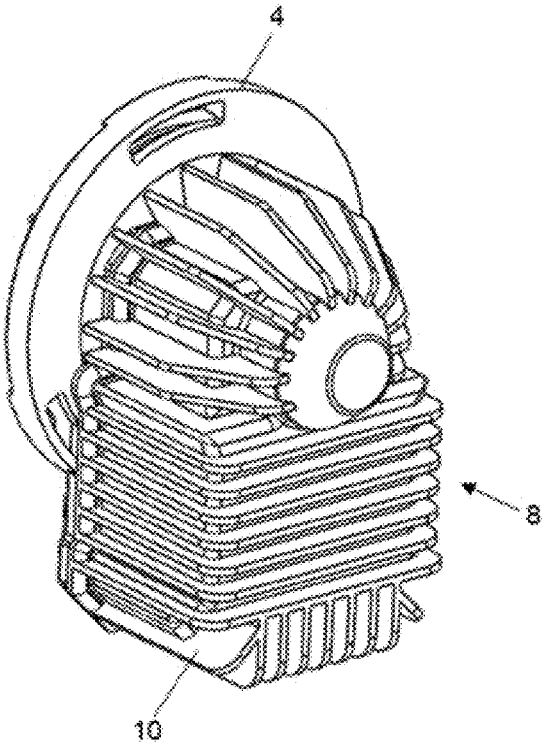
FIG. 7 shows a perspective view of a motor cover according to one implementation.

According to some implementations the cover 8 comprises in its outer contour a plurality of outwardly projecting fins 10 as shown in FIG. 7. The fins 10 advantageously increase the heat transfer surface area of the cover which facilitates a greater exchange of heat by convection from the cover to the surrounding atmosphere. In conjunction with the use of the filler material arranged in the leak-tight chamber 9, the fins 10 further increase the rate at which heat is transferred away from the electric motor 20 cooling.

Pumps, like those described herein, are used for moving or driving a fluid, preferably water, and are normally used in dry environments. An application of this type can be, for example, in drain pumps or recirculation pumps in home appliances, such as a washing machine or a dishwasher, or in driers.

In implementations in which the stator 6 and the stator coil 6*a* are housed in a leak-tight chamber 9, the pump may be used additional environments such as in environments with a high level of humidity, it also being possible for the pump 1 to work immersed in a liquid (such as in fish tanks, aquariums or similar devices).

What is claimed is:

1. An electric motor driven pump comprising:

a pump body, a motor body comprising a rotor enclosure coupled to the pump body, a rotatable impeller arranged on a first side of the rotor enclosure and located inside the pump body, an electric motor arranged on a second side of the rotor enclosure, opposite the first side, the electric motor having a stator, at least one stator coil, electrical terminals connected to the stator coil and a rotor, the rotor including a shaft having a first end and an opposite second end, the first end being coupled with the impeller, a cover disposed over the electric motor, the cover having an open end that is attached to the second side of the rotor enclosure in a leak-tight manner that produces a leak-tight chamber inside the cover, the second end of the shaft of the rotor residing inside the cover, the stator and stator coil being arranged inside the leak-tight chamber, the leak-tight chamber being filled with a liquid or gel filler material that is in contact with the stator, the liquid or gel filler material having a thermal conductivity greater than air.

2. The electric motor driven pump according to claim 1, wherein the filler material is an oil.

3. The electric motor driven pump according to claim 2, wherein the oil is a vegetable oil.

4. The electric motor driven pump according to claim 1, wherein the filler material is a dielectric material.

5. The electric motor driven pump according to claim 1, wherein the stator coil is in contact with the filler material.

6. The electric motor driven pump according to claim 1, wherein the second side of the rotor enclosure comprises a male profile, the open end of the cover comprising a female profile, the male profile being fitted in the female profile to create a leak-tight seal between the male and female parts.

7. The electric motor driven pump according to claim 6, wherein the male profile and the female profile are fixed together by a weld.

8. The electric motor driven pump according to claim 6, wherein the male profile and the female profile are fixed together by the use of an adhesive.

9. The electric motor driven pump according to claim 6, wherein an elastic joint is arranged between the male profile and the female profile.

10. The electric motor driven pump according to claim 1, wherein the rotor enclosure comprises a window through which the terminals pass from inside the leak-tight chamber to the outside of the leak-tight chamber, the electric motor driven pump further comprising a terminal connection part that is housed in the window in a leak-tight manner, the terminals passing from inside the leak-tight chamber to the outside of the leak-tight chamber through the terminal connection part.

11. The electric motor driven pump according to claim 10, wherein the terminal connection part comprises through passages through which the terminals pass from the inside of the leak-tight chamber to the outside of the leak-tight chamber, the electric motor driven pump further comprising a sealant disposed on an outer side of the terminal connection part at junctions where the terminals pass out of the through passages.

12. The electric motor driven pump according to claim 10, further comprising an elastic sealing part that provides a seal between the terminal connection part and the window and also provides a seal between the terminals and the terminal connection part.

13. The electric motor driven pump according to claim 12, wherein a portion of the elastic sealing part that provides the seal between the terminals and the terminal connection part includes a constriction through which the terminals pass.

14. The electric motor driven pump according to claim 1, wherein the terminals include a first part and a second part, the first part being disposed inside the leak-tight chamber and in contact with the filler material, the second part being located outside the leak-tight chamber.

15. The electric motor driven pump according to claim 1, further comprising a thermal protector connected with the coil and being disposed inside the leak-tight chamber in contact with the filler material.

16. The electric motor driven pump according to claim 1, wherein the cover comprises a plurality of outwardly projecting fins.

17. The electric motor driven pump according to claim 1, wherein the cover is made of plastic.

18. The electric motor driven pump according to claim 17, wherein the rotor enclosure is made of plastic.

19. The electric motor driven pump according to claim 1, wherein the filler material has a thermal conductivity of at least five times the thermal conductivity of air.

* * * * *